US006097266A

United States Patent [19]

Nardozza et al.

[11] Patent Number: 6,097,266

[45] Date of Patent: Aug. 1, 2000

[54] INTELLIGENT RF COMBINER

[75] Inventors: Gregg Scott Nardozza, McAfee; Christopher Walker Rice, Parsippany, both of N.J.

[73] Assignee: Lucent Technologies Inc, Murray Hill, N.J.

[21] Appl. No.: 09/134,196

[22] Filed: Aug. 14, 1998

[51] Int. Cl.[7] ..... H01P 1/10; H01P 5/12

[52] U.S. Cl. ..... 333/101; 333/104; 333/127

[58] Field of Search ..... 333/101, 103, 333/104, 124, 127, 128; 330/124 B, 124 D

[56] References Cited

U.S. PATENT DOCUMENTS 5,754,082 5/1998 Swanson ..... 333/124
5,767,755 6/1998 Kim et al. ..... 333/101
5,783,975 7/1998 Nakamura ..... 333/101
5,872,491 2/1999 Kim et al. ..... 333/101

FOREIGN PATENT DOCUMENTS 2738840 6/1978 Germany ..... 333/124

*Primary Examiner*—Paul Gensler

[57] ABSTRACT

An RF coupler incorporating a pair of branch circuits which combine first and second input signals supplied at the same impedance level, amplitude and phase into an output signal at the same impedance level, twice the amplitude and phase shifted with respect to the input signals when both input signals are present, and which, if only one of the input signals is present, passes that input signal through its branch circuit to the output without loss, while terminating the branch circuit associated with the absent input signal with an equal impedance.

14 Claims, 7 Drawing Sheets

INTELLIGENT RF COMBINER

BACKGROUND OF THE INVENTION

1. Field of the Invention

This invention relates to amplifier apparatus and, more particularly, to power amplifier output apparatus operating at radio frequencies.

2. Description of the Related Art

Electrical circuits which combine pairs of amplifier input signals supplied at the same impedance level, frequency and phase into an output signal at the same impedance level, frequency and phase are known in the art. Whether of the typical Branchline, Gysel or Wilkinson coupler configurations, these electrical circuits exhibit a 6 dB power loss (3 dB from the amplifier and 3 dB from the combiner) if one of the input signals is not present—for example, as a result of amplifier failure. Where the output signal developed is coupled to an antenna configuration in a cellular communications system, for instance, the end result is a decrease in coverage for the cell site, and a resultant inability for users to transmit to a Base Station in obtaining optimum phone service.

SUMMARY OF THE INVENTION

As will be seen from the following description, the radio frequency (RF) combiner of the present invention incorporates a pair of branch circuits which combine first and second amplifier input signals supplied at the same impedance level, frequency and phase into a power output signal at the same impedance level, frequency and phase when both signals are present; and which, if only one of the input signals is present, passes that input signal along its branch circuit to the output without loss, while terminating the branch circuit associated with the absent (i.e. missing or failed) input signal with an equal impedance.

As will also be seen, a preferred embodiment includes the placement of a plurality of switches, transmission line lengths and resistors in the combiner to terminate either one of the branch circuits with an equal impedance in the event its associated input signal is absent, while passing that input signal which is present without loss to the output. In this embodiment, means are provided to sense the presence of the first and second amplifier input signals, and to respond in controlling the conductivity conditions of the various switches in response. Particularly attractive for use at cellular frequencies of 824–894 MHz and at personal communication service frequencies of 1850–1990 MHz, the preferred embodiment of the invention additionally operates to open and close individual ones of the plurality of switches employed in terminating neither of the branch circuits when both first and second input signals are present, and which terminate either one of the branch circuits when its input signal is missing with a 50 ohm impedance—comparable to that common in these cellular and personal communication service system environments. In this embodiment, the combiner of the invention will be seen to provide its power output signal as a vectorial in-phase addition of the first and second input signals when both such input signals are present, and as an equal amplitude (no loss) phase shifted version with respect to the active input signal when the other input signal is absent.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
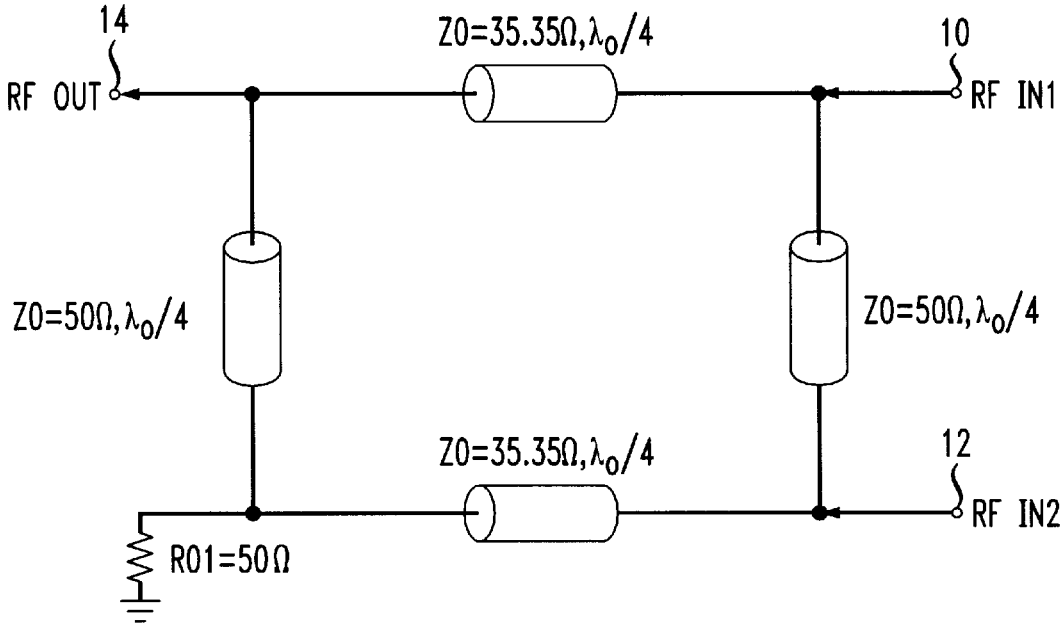
FIG. 1 PRIOR ART
FIGS. 1–3 are schematic diagrams of the respective Branchline, Gysel and Wilkinson couplers known in the prior art.
Figure 2:
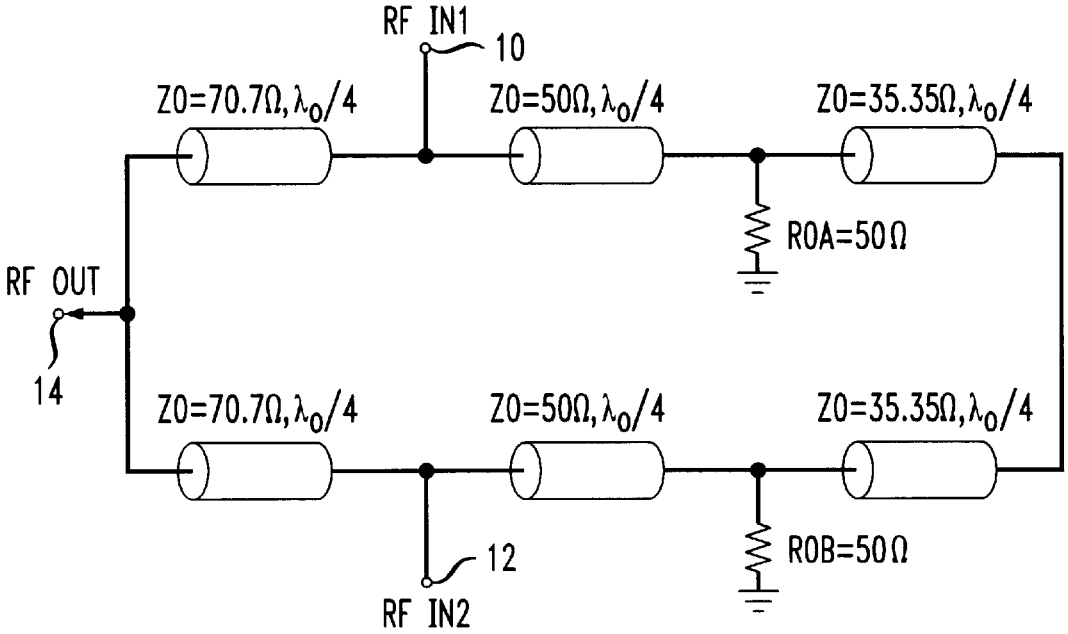
FIG. 2 PRIOR ART
Figure 3:
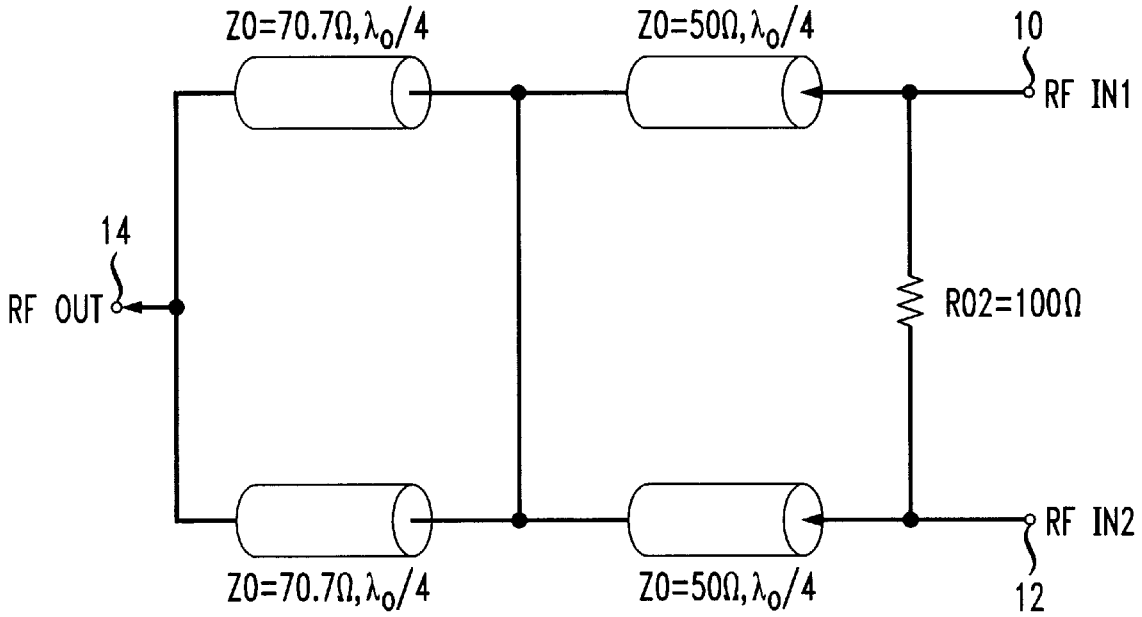
FIG. 3 PRIOR ART

In the Branchline, Gysel and Wilkinson couplers of FIGS. 1–3, amplifier input signals are supplied at terminals 10, 12 as RF IN 1 and RF IN 2, respectively, and combine to provide an output power signal at terminal 14 as RF OUT. As is known, to produce the power output signal at the same impedance level, frequency and relative phase as the two input signals, the resistors R are selected of prescribed value, and transmission lines Z are selected of predetermined impedance and number of wavelengths ($\lambda_o$). Thus, when operating in a 50 ohm environment—the most common for cellular and other RF microwave systems—the values necessary to accomplish this are as shown (with RO indicating the resistance and ZO indicating the impedance and $\lambda_{o/n}$ wavelengths, where n is either 2, 4 or 8 depending on the coupler). As is also known, such resistances, impedances and wavelengths are different in other systems, e.g. broadband systems, as used in cable and other environments, where 75 ohm impedances are the most common. However, with these arrangements, where only one of the RF input signals is present at the terminals 10, 12, a 6 dB power loss manifests itself at the output terminal 14—as, for example, if one of the amplifiers providing the RF input should fail.

The combiners of the invention shown in FIGS. 4–8, on the other hand, overcome this undesirable effect, in combining both amplifier input signals into the output signal at the same impedance level, frequency and relative phase when both inputs are present, and which continues to couple to the output terminal 14 without loss, that input signal which is present, in the event the other input signal is missing.

Figure 5:
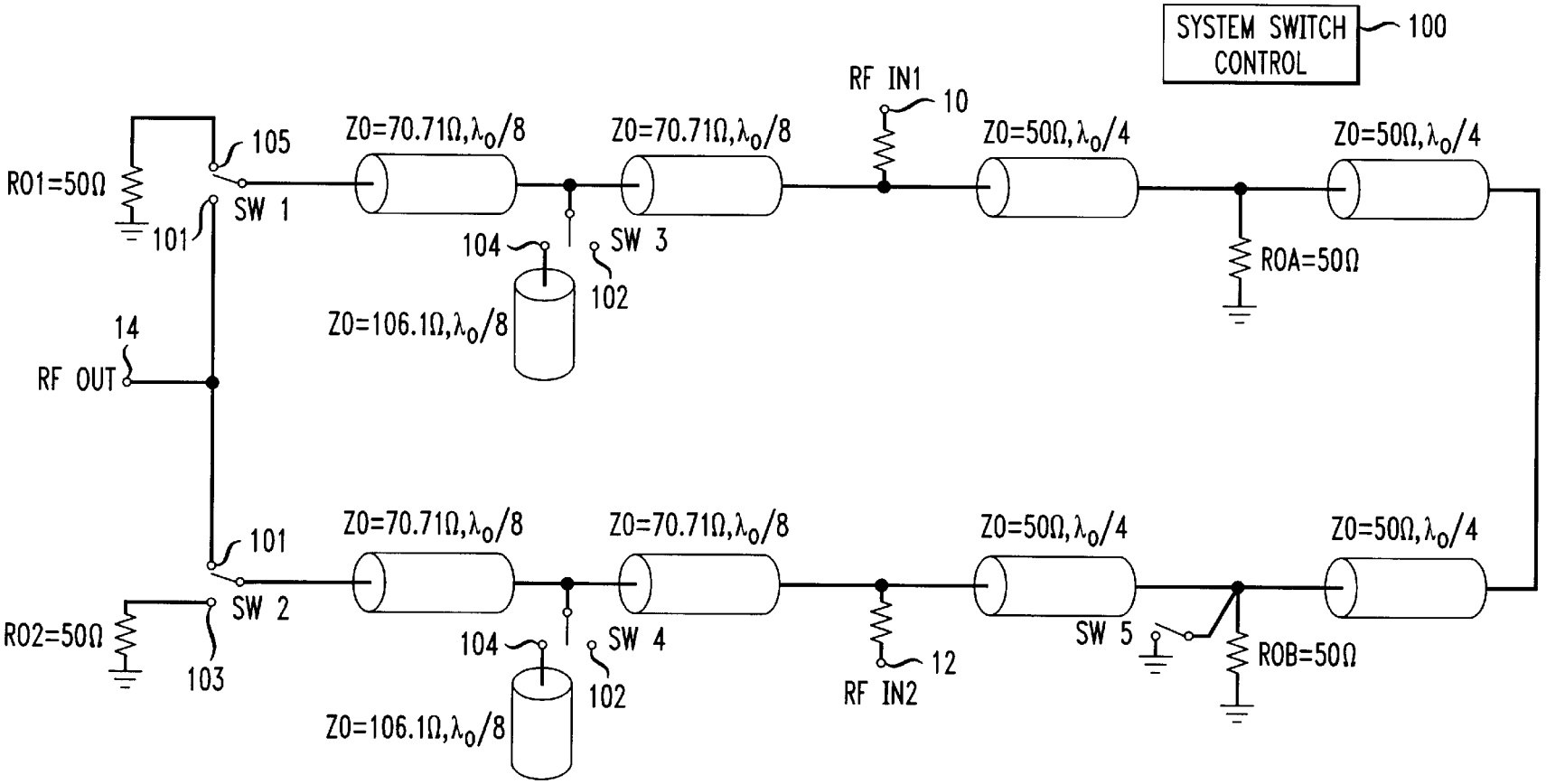
FIGS. 5–8 are schematic diagrams of alternate RF combiners constructed in accordance with the invention in providing a power output signal which is the in-phase vectorial addition of both active RF input signals, and in terminating either one of its two branch circuits with an equal impedance in the event its associated input signal is absent while continuing to pass that input signal which is present to the output without loss.
Figure 6:
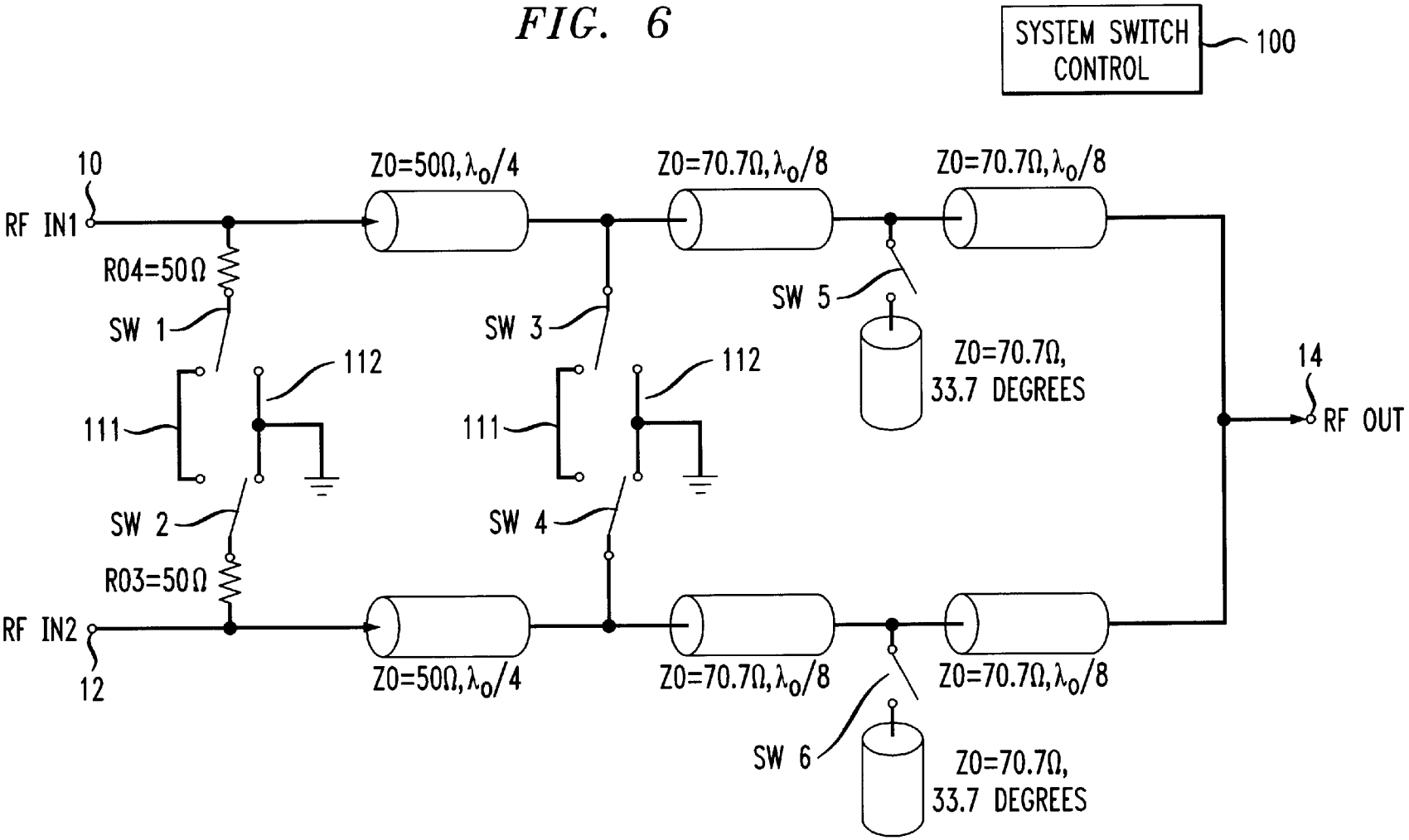
Figure 7:
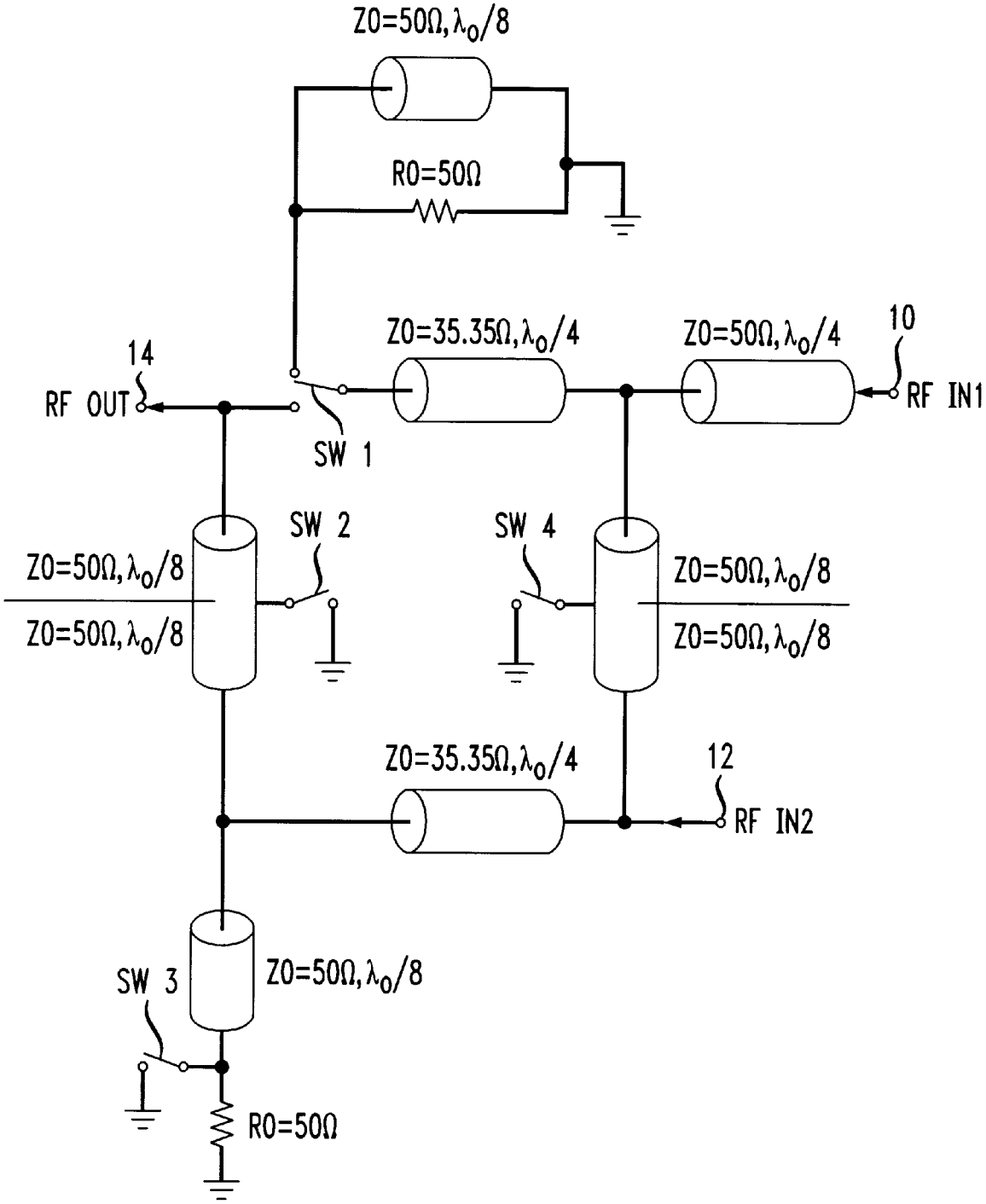
Figure 8:
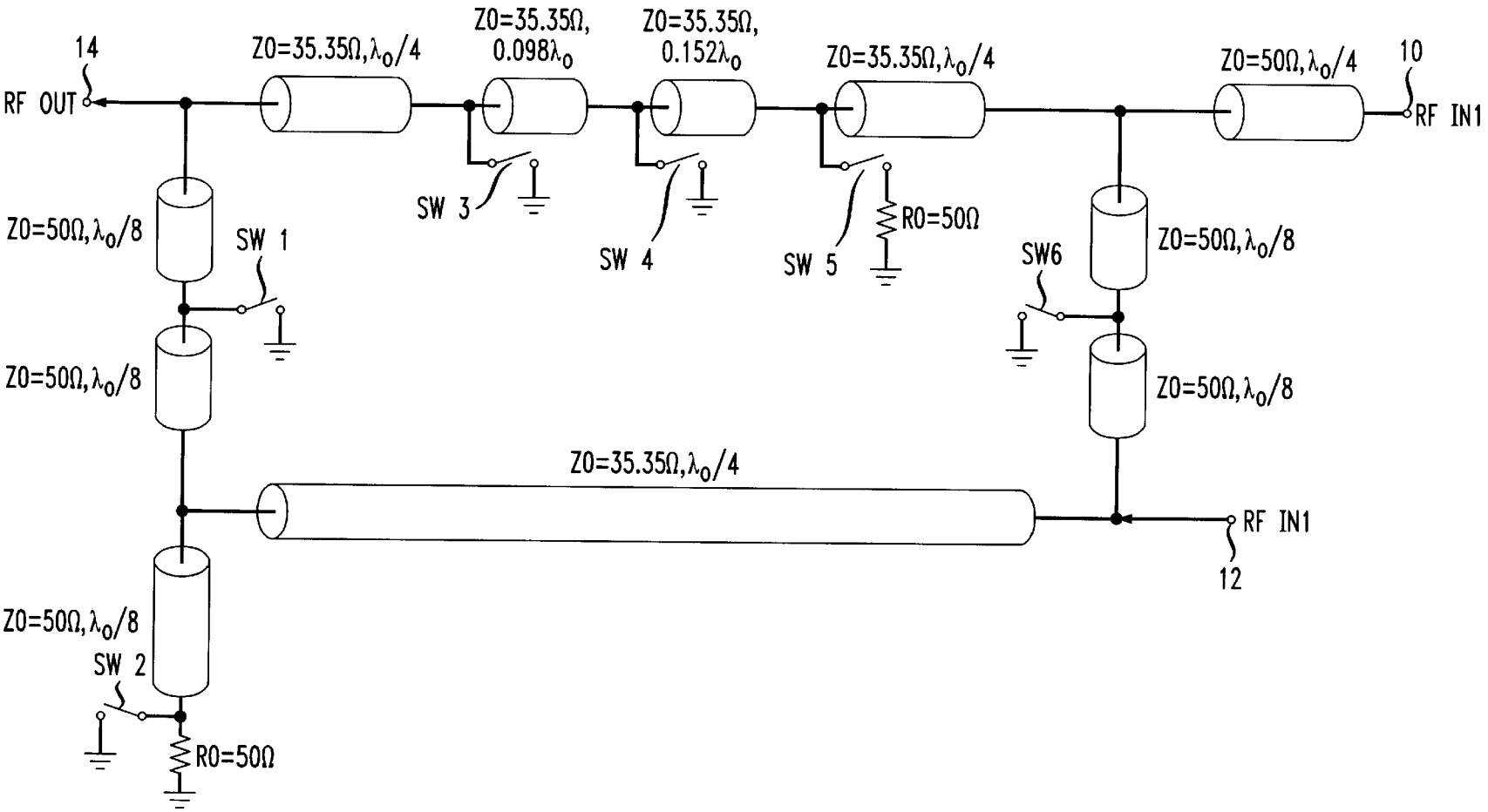

In considering the following, it should first be understood that the resistances, transmission line impedances and wavelengths described are those needed to provide these results for a 50 ohm system—the particular values requiring re-figuring, as with the couplers of the prior art, where 75 ohm, or 100 ohm, impedance systems are utilized. It will also be noted that each of these arrangements of FIGS. 4–8 includes the placement of a plurality of switches to terminate either one of the branch circuits with an equal impedance in the event its associated input signal is absent (i.e., missing or failed) while passing the input signal which is present to the output without loss. It will additionally be noted that individual ones of these plurality of switches are opened and/or closed, dependent upon the detection of the presence or absence of the two input signals, as by a system control unit. In this respect, the preferred embodiment of FIG. 4 will be seen to be a modification of the Branchline coupler of FIG. 1, while the embodiments of FIGS. 5 and 6 are essentially modifications of the Gysel and Wilkinson couplers of FIGS. 2 and 3, respectively. FIGS. 7 and 8 are yet further embodiments of the invention—again, including the placement of a plurality of switches, transmission line lengths and resistors, and in which the switches are operated on by the control unit to terminate neither of the branch circuits when both RF input signals are present, and to terminate either one of the branch circuits with a 50 ohm impedance in the event its associated input signal were to be absent. In each of FIGS. 4–8, the system control unit is identified by the reference notation 100, and the various switches utilized are indicated by the notation "SW 1", "SW 2", "SW 3" . . . . The resistors and transmission line impedance values continue to be represented by the notations RO and ZO, respectively, and with the resistance and impedance values indicated. Transmission lines lengths are represented by $\lambda_{o/n}$ where n=2, 4 or 8 depending upon the coupler.

Figure 4:
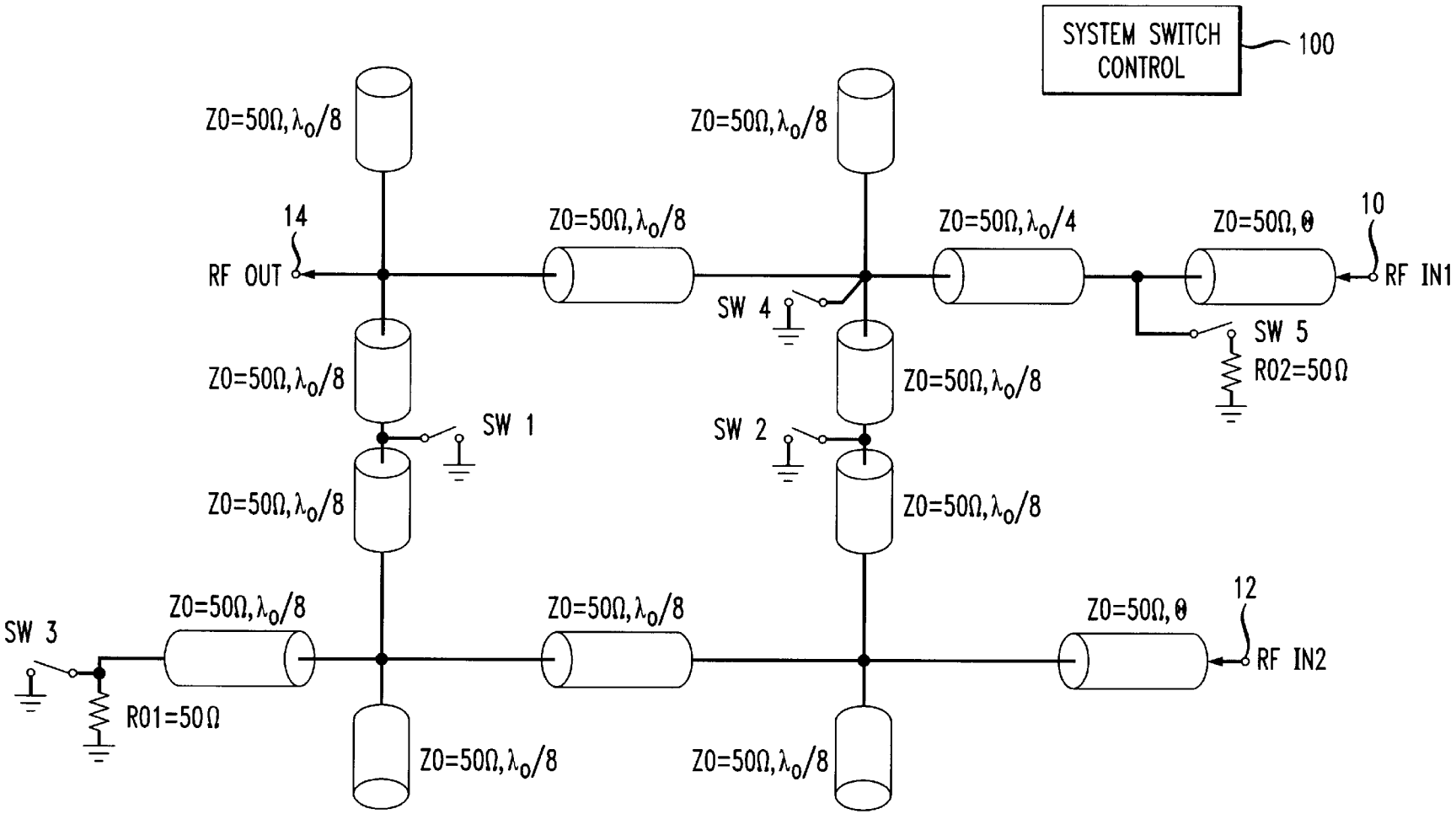
FIG. 4 is a schematic diagram of a preferred embodiment of an RF combiner constructed in accordance with the teachings of the present invention.

The embodiment of FIG. 4 is to be preferred, as it is easier to manufacture from a fabrication standpoint, and also because of the simplicity of its switch arrangements. Additionally, the switches employed connect to ground in shunt, without any of the high power amplifier inputs coupling through them in series. Aside from this, a review of its operation will be appreciated as being comparable to that of the arrangements of FIGS. 5–8—with all of them providing a combined output signal of the two input signals, in-phase, when both input signals are present, and which avoids any coupler power loss in passing the signal which is present, when the other input signal is absent.

More specifically, in the combiner of FIG. 4, with the resistors RO and the transmission lines ZO as shown, when both RF input signals are present at terminals 10 and 12, with the same amplitude and phase, the system control unit 100 conditions all switches SW 1–SW 5 to remain open. The configuration then operates as an in-phase combiner, with the amplified input signals at terminals 10 and 12 being coupled to the output terminal 14, at matched impedance.

If only the amplified RF signal at terminal 10 is present, the system control unit 100 operates to close switches SW 1 and SW 2, and conditions switches SW 3, SW 4 and SW 5 to remain open. In this situation, the amplified input signal at terminal 10 is coupled to output terminal 14 through a 50 ohm line. The input terminal 12 couples with resistor RO1 through a 50 ohm line.

Where, on the other hand, only the amplified RF signal at terminal 12 is present, the system control unit 100 conditions switch SW 1 to remain open, and closes switches SW 2, SW 3, SW 4 and SW 5. The amplified input signal at terminal 12 is coupled to output terminal 14 through a 50 ohm line, while the input terminal 10 couples with resistor RO2 through a 50 ohm line.

With the five switches SW 1 through SW 5 strategically placed in this manner, and with the values shown, either non-functional or missing input RF IN 1 or RF IN 2 is thus terminated with a 50 ohm impedance, while the input signal which is active is coupled to the output without loss, and at the same 50 ohm impedance.

In the modified Gysel coupler of the invention of FIG. 5, when both RF input signals are present at terminals 10 and 12 with the same amplitude and relative phase, the system control unit 100 conditions switch SW 5 to remain open, conditions switches SW 1 and SW 2 towards the position 101, and conditions the switches SW 3 and SW 4 towards the NO CONNECT position 102. The configuration then operates as an in-phase combiner, with the amplified input signals at terminals 10 and 12 being coupled to the output terminal 14, at matched impedance.

If only the amplified RF signal at terminal 10 is present, the system control unit 100 operates to condition switch SW 1 towards position 101, and conditions switch SW 2 to position 103 and the 50 ohm load at RO2. At the same time, the control unit 100 conditions switches SW 3 and SW 4 to the position 104, coupling in a transmission line open circuit of 106.1 ohm impedance, of one-eighth wavelength. Lastly, the control unit 100 closes switch SW 5 to ground. In this manner, the amplified input signal at terminal 10 is coupled to output terminal 14 through a 50 ohm load while the input terminal 12 couples with resistor RO2 through a 50 ohm line.

Where, on the other hand, only the amplified RF signal at terminal 12 is present, the system control unit 100 conditions switch SW 2 towards position 101, conditions the switch SW 1 towards the position 105 and the 50 ohm load at RO1. At the same time, control unit 100 conditions switches SW 3 and SW 4 to position 104, coupling in the transmission line open circuit of 106.1 ohm impedance, of one-eighth wavelength. Lastly, the control unit 100 closes switch SW 5 to ground. With this arrangement, the amplified input signal at terminal 12 is coupled to output terminal 14 through a 50 ohm line, while the input terminal 10 couples with resistor RO1 through a 50 ohm line.

With the five switches SW 1 through SW 5 strategically placed in this manner, and with the values shown, either missing input RF IN 1 or RF IN 2 is thus terminated with a 50 ohm impedance, while the input signal which is active is coupled to the output without loss, and at the same 50 ohm impedance.

In the modified Wilkinson coupler of FIG. 6, when both RF input signals are present at terminals 10 and 12 with the same amplitude and relative phase, the system control unit 100 (which monitors this), conditions switches SW 1, SW 2, SW 3 and SW 4 to the left position 111, and conditions SW 5 and SW 6 to remain open. The configuration, as with those of FIGS. 4 and 5, then operates as an in-phase combiner, with the amplified input signals at terminals 10 and 12 being coupled to the output terminal 14, and all terminals are matched.

If only the amplified RF signal at terminal 10 is present, the system control unit 100 conditions switches SW 1 and SW 3 to position 111, and conditions switches SW 2 and SW 4 to the position 112, indicated as ground. At the same time, the system control unit 100 conditions switches SW 5 to close—coupling in a transmission line open circuit of 70.7 ohm impedance, of 33.7 degrees—and switch SW 6 to remain open. In this event, the amplified input signal at terminal 10 couples through to output terminal 14 through a 50 ohm line, while the input terminal 12 couples to ground through a 50 ohm resistor RO3.

Where, on the other hand, only the amplified RF signal at terminal 12 is present, the system control unit 100 conditions switches SW 2 and SW 4 to position 111, conditions switches SW 1 and SW 3 to position 112, closes switch SW 6 to couple in a transmission line length open circuit of 70.7 ohm impedance, of 33.7 degrees, and conditions switch SW 5 to remain open. The amplified input signal at terminal 12 is then coupled through to output terminal 14 through a 50 ohm line, while the input terminal 10 couples to ground through a 50 ohm resistor RO4.

With the six switches SW 1 through SW 6 strategically placed between the resistors and transmission line lengths in this manner, and with the values shown in FIG. 6, either missing input is thus terminated with a 50 ohm impedance, while the input signal which is active is coupled to the output without loss, and at the same 50 ohm impedance.

FIGS. 7 and 8 illustrate further embodiments of the combiner of the invention, yet with other combinations of resistors, transmission lines and switches—four switches SW 1 through SW 4 in FIG. 7, and six switches SW 1 through SW 6 in FIG. 8. With the resistance values and with the impedance and wavelengths illustrated, an analysis can be obtained (as in the manners of FIGS. 4–6) as to the various combinings which take place where both amplified input signals are present at terminals 10 and 12, or where only one input signal is present. By closing and/or opening various ones of the switches in either configuration, a comparable result is achievable—namely, an in-phase combining operation is present when both amplified input signals are in-use and functional, with the amplified input signals then combining in amplitude, phase and impedance, with all terminals thus being matched. Where, on the other hand, only one amplified input signal is present, that amplified input signal couples through to the output terminal 14 without loss, while the non-used or non-functional input terminal is terminated with the 50 ohm characteristic impedance of the system environment. As will also be understood, if the two input signals are supplied at the same amplitude level, the output signal with the combiner of the invention will be at twice the amplitude of the inputs; on the other hand, if the two input signals are of differing amplitude levels, the combined output will be seen to be at an amplitude equal to the sum of the two input signals.

While there have been described what are considered to be preferred embodiments of the present invention, it will be readily appreciated by those skilled in the art that modifications may be made without departing from the scope of the teachings herein. For at least such reason, therefore, resort should be had to the claims appended hereto for a true understanding of the scope of the invention.

We claim:

1. In a radio frequency signal coupler incorporating a pair of branch circuits operative to respectively combine in-phase first and second input signals, each of which is supplied at the same impedance level, amplitude and phase into a single output signal at the same impedance level as the input signals, twice the amplitude of the input signals and phase shifted with respect to the input signals, the improvement comprising the placement of a plurality of switches, transmission line lengths and resistors in said coupler to terminate, when only one input signal is present, that branch circuit at which its associated input signal is absent with an impedance equal to that at which its associated input signal would be supplied at were such input signal to be present, while passing both input signals when present to the output as an in-phase addition of said first and second input signals.

2. The improvement of claim 1, including means sensing the presence of said first and second input signals, and controlling the conductivity condition of said switches in response thereto.

3. The improvement of claim 2, wherein said means selectively opens and closes individual ones of said plurality of switches dependent upon detection of the presence or absence of said first and second input signals.

4. The improvement of claim 3, wherein said means selectively opens and closes individual ones of said plurality of switches to terminate neither of said branch circuits when both said first and second input signals are present.

5. The improvement of claim 4, wherein said means selectively opens and closes individual ones of said plurality of switches to provide a combined output signal of zero relative phase shift with respect to said first and second input signals when both said first and second input signals are present.

6. The improvement of claim 5 in combining first and second input signals supplied at a 50 ohm impedance level, wherein said means terminates either one of said branch circuits with a 50 ohm impedance in the event its associated input signal were to be absent.

7. The improvement of claim 6, wherein said means provides a combined output signal for first and second input signals present within a frequency range of 824–894 MHz.

8. The improvement of claim 6, wherein said means provides a combined output signal for first and second input signals present within a frequency range of 1850–1990 MHz.

9. In a radio frequency signal coupler incorporating a pair of branch circuits operative to respectively combine in-phase first and second input signals, each of which is supplied at the same impedance level and phase into a single output signal at the same impedance level as the input signals and phase shifted with respect to the input signals, the improvement comprising the placement of a plurality of switches, transmission line lengths and resistors in said coupler to terminate, when only one input signal is present, that branch circuit at which its associated input signal is absent with an impedance equal to that at which its associated input signal would be supplied at were such input signal to be present, while passing both input signals when present to the output as an in-phase addition of said first and second input signals.

10. The improvement of claim 9, including means sensing the presence of said first and second input signals, and controlling the conductivity condition of said switches in response thereto.

11. The improvement of claim 10, wherein said means selectively opens and closes individual ones of said plurality of switches dependent upon detection of the presence or absence of said first and second input signals.

12. The improvement of claim 11, wherein said means selectively opens and closes individual ones of said plurality of switches to provide a combined output signal of zero relative phase shift with respect to said first and second input signals when both said first and second input signals are present.

13. The improvement of claim 12, wherein said means selectively opens and closes individual ones of said plurality of switches to provide said combined output signal at an amplitude level substantially equal to the sum of the amplitudes of said first and second input signals.

14. In a radio frequency signal coupler incorporating a pair of branch circuits operative to respectively combine in-phase first and second input signals, each of which is supplied at the same impedance level, amplitude and phase into a single output signal at the same impedance level as the input signals, twice the amplitude of the input signals and phase shifted with respect to the input signals, the improvement comprising configuring, to terminate, when only one input signal is present, that branch circuit at which its associated input signal is absent with an impedance equal to that at which its associated input signal would be supplied at were such input signal to be present, while passing both input signals when present to the output as an in-phase addition of said first and second input signals.

* * * * *

UNITED STATES PATENT AND TRADEMARK OFFICE

CERTIFICATE OF CORRECTION

PATENT NO. : 6,097,266
DATED : August 1, 2000
INVENTOR(S) : Gregg S. Nardozza & Christopher W. Rice It is certified that error appears in the above-identified patent and that said Letters Patent is hereby corrected as shown below:

Title page,
The Assignee identified on the front page of the above-identified Patent is corrected to be Lucent Technologies Inc. of Murray Hill, New Jersey, and AT&T Corp. of New York, New York.

Signed and Sealed this

Eighth Day of January, 2002

*Attest:*

*Attesting Officer*

JAMES E. ROGAN
*Director of the United States Patent and Trademark Office*